US006524133B2

(12) United States Patent
Murakami

(10) Patent No.: US 6,524,133 B2
(45) Date of Patent: Feb. 25, 2003

(54) CONNECTOR

(75) Inventor: Takao Murakami, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/058,400

(22) Filed: Jan. 30, 2002

(65) Prior Publication Data

US 2002/0102878 A1 Aug. 1, 2002

(30) Foreign Application Priority Data

Jan. 31, 2001 (JP) ..... 2001-023918

(51) Int. Cl.[7] ..... H01R 13/73
(52) U.S. Cl. ..... 439/595
(58) Field of Search ..... 439/595, 744, 439/871

(56) References Cited

U.S. PATENT DOCUMENTS 4,387,943 A * 6/1983 Werth et al. ..... 439/595
5,057,040 A * 10/1991 Kodama et al. ..... 439/594
5,187,862 A * 2/1993 Ohsumi ..... 29/758
5,554,051 A * 9/1996 Shinji et al. ..... 439/595
5,575,684 A 11/1996 Uchida et al.
5,645,452 A * 7/1997 Kodama ..... 439/595
5,769,663 A 6/1998 Kodama
5,839,921 A * 11/1998 Yamanashi ..... 439/595

* cited by examiner

*Primary Examiner*—Tulsidas Patel
*Assistant Examiner*—Phuong KT Dinh
(74) *Attorney, Agent, or Firm*—Finnegan, Henderson, Farabow, Garrett & Dunner, L.L.P.

(57) ABSTRACT

A connector (10) with a connector housing (11) having a Terminal housing chamber 14 into which a terminal (32) is inserted from the rear. An engaged portion (32*b*) of the terminal (32) is engaged with a flexible engagement arm (17) which is protruded into the terminal housing chamber (14). At each side of the flexible engagement arm (17), a protrusion (17*e* ) for disengagement by a tool is provided for disengaging the engaging portion (18) of the flexible engagement arm (17) from the engaged portion (32*b*) of the terminal (32).

2 Claims, 9 Drawing Sheets

CONNECTOR

BACKGROUND OF THE INVENTION

This invention relates to a connector having a terminal engaging/disengaging structure in which a terminal held in a terminal housing chamber of a connector housing is engaged/disengaged with/from a flexible engagement arm.

FIG. 1 shows a connector 1 having this kind of terminal engaging/disengaging structure, which was reviewed by the present inventors. The connector 1 is provided with a flexible engagement protrusion 5 for engagement with a terminal 4 held in a terminal housing chamber 3 of a connector housing 2. The protrusion 5 is arranged opposite to the housing chamber 3 and slightly protrudes into the housing chamber 3.

Specifically, the engagement protrusion 5 is extended forwardly from a rear portion of the connector housing 2 so as to obliquely protrude into the terminal housing chamber 3. The terminal 4 has an opening (not shown) at its bottom with which the distal end of the protrusion 5 engages.

In fitting the terminal 4 into the connector 1, the terminal 4 is inserted from a terminal insertion opening (not shown) provided at the rear of the connector housing 2. During the insertion, the terminal 4 flexes the protrusion 5 protruded into the housing chamber 3 outward of the chamber 3. With the terminal 4 inserted deeper into the housing chamber 3, an engagement stage 6 of the protrusion 5 engages with the opening at the bottom of the terminal 4 so that the terminal 4 is engaged so as not to be pulled out from the housing 2.

Now the shape of the distal end portion of the engagement protrusion 5 will be described with reference to FIGS. 2 and 3. The distal end portion of the protrusion 5 has two left and right sections. One section is the engagement stage 6 bulging out into the terminal housing chamber 3. The other section is a disengagement oblique guiding surface 7.

Specifically, as shown in FIG. 3, at the distal end portion of the protrusion 5, the oblique guiding surface 7 is provided at an eccentric position with respect to the width S1 of the protrusion 5.

In order to remove the terminal 4 engaged with the protrusion 5 from the connector housing 2, a rod 8 as shown in FIG. 1 is used. The rod 8 is inserted from an insertion opening 9 formed at the front end of the connector housing 2, into the terminal housing chamber 3, and is guided on the side surface of the terminal 4 to the oblique guiding surface 7.

The rod 8 is pushed onto the guiding surface 7, and the front end of the rod 8 slides on the guiding surface 7 and bends the protrusion 5 outside the housing chamber 3. As a result, the engagement stage 6 formed at the distal end portion of the protrusion 5 is disengaged from the terminal 4, and the terminal 4 can be pulled rearward to be removed from the housing 2.

However, since the guiding surface 7 is provided only at the eccentric position with respect to the width S1 of the protrusion 5, at the distal end portion of the protrusion 5 as shown in FIG. 3, the protrusion 5 is subjected to torsion when disengaged by the rod 8, resulting in low disengagement performance.

Further, since the rod 8 contacts the terminal 4, the rod 8 is likely to damage the bottom surface of the terminal 4 or deform the terminal 4.

SUMMARY OF THE INVENTION

It is thus an object of this invention to provide a connector with improved operativity in removing a terminal, reliably preventing deformation of or damage to the terminal being removed.

According to a first aspect of this invention, there is provided a connector which comprises: a connector housing; a terminal housing chamber provided in the connector housing; a flexible engagement arm protruding into the terminal housing chamber, the engagement arm having an engaging portion which engages with an engaged portion of a terminal inserted into the terminal housing chamber from the rear thereof; and a protrusion for disengagement by a tool, provided at each side of the flexible engagement arm for disengaging the engaging portion of the flexible engagement arm from the engaged portion of the terminal.

Since the connector has the protrusion for disengagement by a tool provided on each side of the flexible engagement arm, when the engaged portion of the terminal is detached to be pulled out from the engaging portion of the engagement arm in the terminal housing chamber using a disengagement tool, the engagement arm is prevented from being torsionally dislocated, and the terminal is removed easily and reliably, resulting in improved terminal removing operation.

According to a second aspect of this invention, a connector according to the first aspect further comprises a pair of supporting arms for supporting the front end of the flexible engagement arm at a front portion of the connector housing and supporting the rear end of the flexible engagement arm at a rear portion of the connector housing, the supporting arms forming a slit sized to allow a body of the terminal to be held therein, the slit being extending from the front end of the flexible engagement arm to the engaging portion, wherein the protrusion for disengagement is provided at an outer surface of each supporting arm, protruding outward.

Since this connector has the body of the terminal held in the slit between the supporting arms of the flexible engagement arm, and has the protrusion for disengagement by a tool provided at the outer surface of each supporting arm, when the terminal is removed with the disengagement tool, the tool does not directly contact the terminal while disengaging the engaging portion of the engagement arm from the engaged portion of the terminal. Thus the terminal is prevented from being deformed or damaged by the tool when removed.

DETAILED DESCRIPTION OF THE PREFERRED EMBODIMENT

Figure 1:
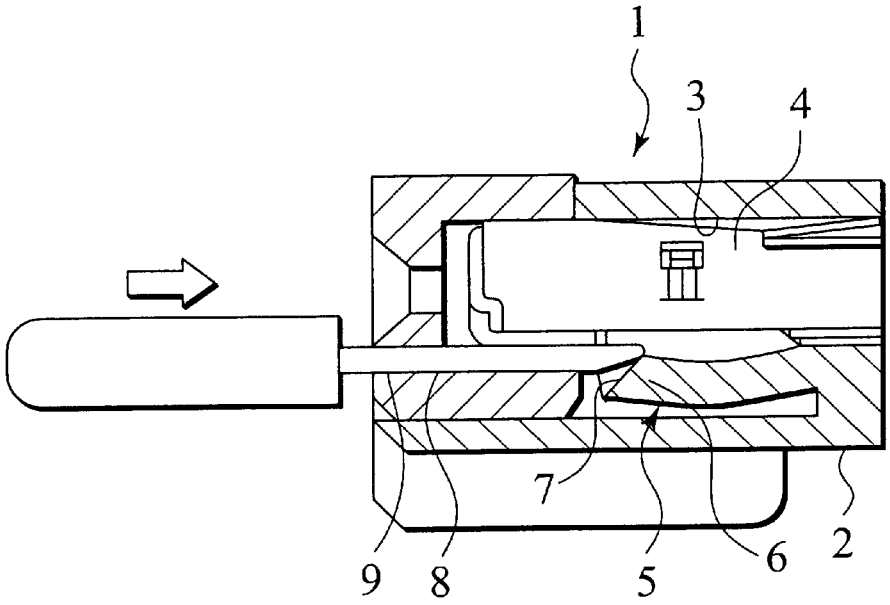
FIG.1 BACKGROUND ART
FIG. 1 is a partial cross-sectional view of a conventional connector.
Figure 2:
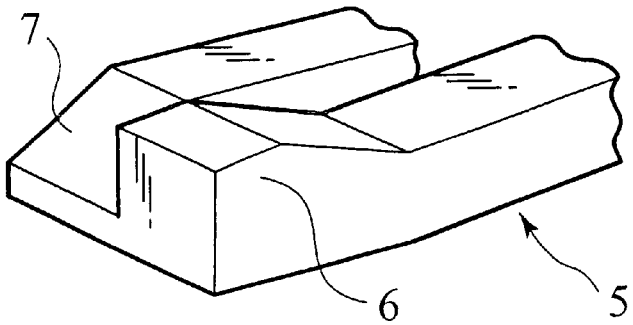
FIG.2 BACKGROUND ART
FIG. 2 is a partial perspective view of an essential portion of the conventional connector.
Figure 3:
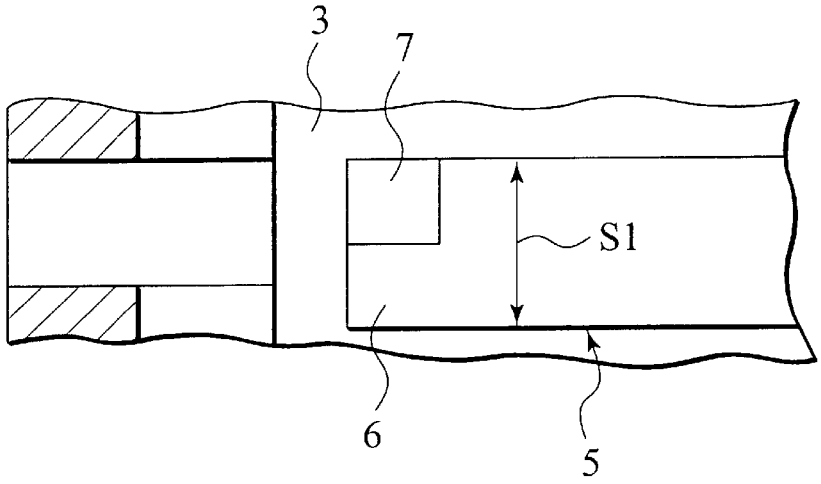
FIG.3 BACKGROUND ART
FIG. 3 is a plan view illustrating the essential portion of the conventional connector.
Figure 4:
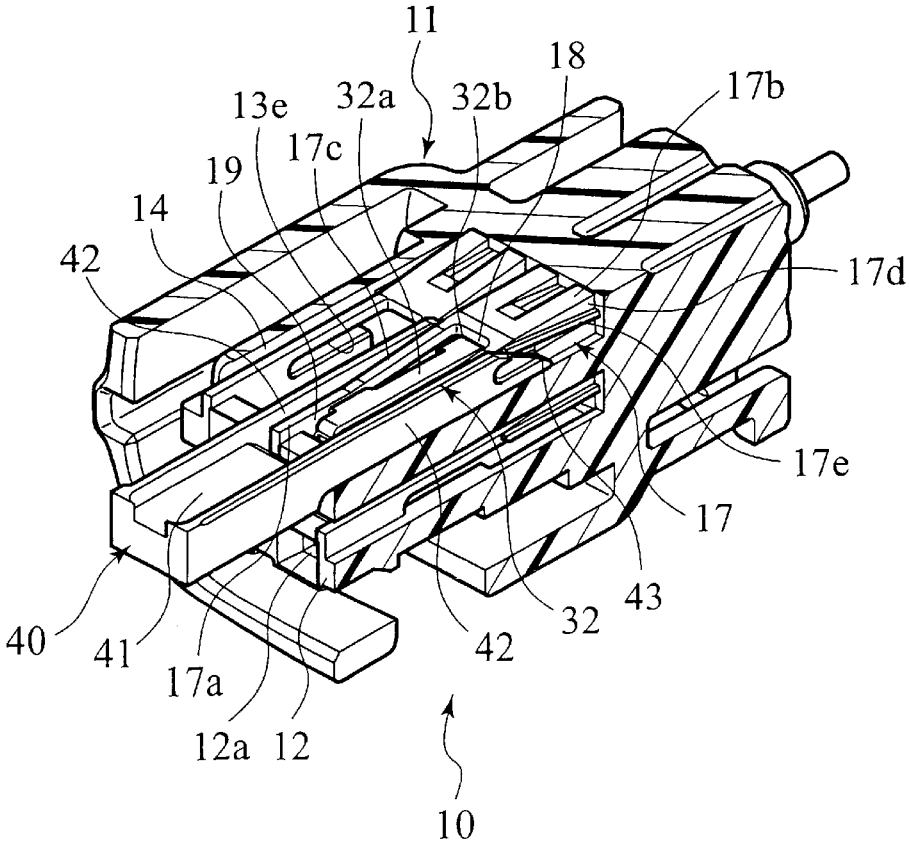
FIG. 4 is a partial perspective view of a connector according to an embodiment of this invention, with an essential portion shown in cross section.

With reference to the accompanying drawings, an embodiment of this invention will be described in detail below.

Referring to FIGS. 4 to 14, a connector housing 11 of a connector 10 made from synthetic resin has a plurality of terminal housing chambers 14 and rubber plug housing chambers 15 which are partitioned vertically into two and laterally (into three in this embodiment) by a front wall 12 and a peripheral wall 13. Each terminal housing chamber 14 is formed in a rectangular hollow shape, and each rubber plug housing chamber 15 is formed in a cylindrical shape. These housing chambers 14 and 15 communicate with one another so as to hold a female terminal 32 with a wire 30 and a rubber plug 31 crimped thereon, inserted thereinto from a rear terminal insertion opening 16.

Figure 5:
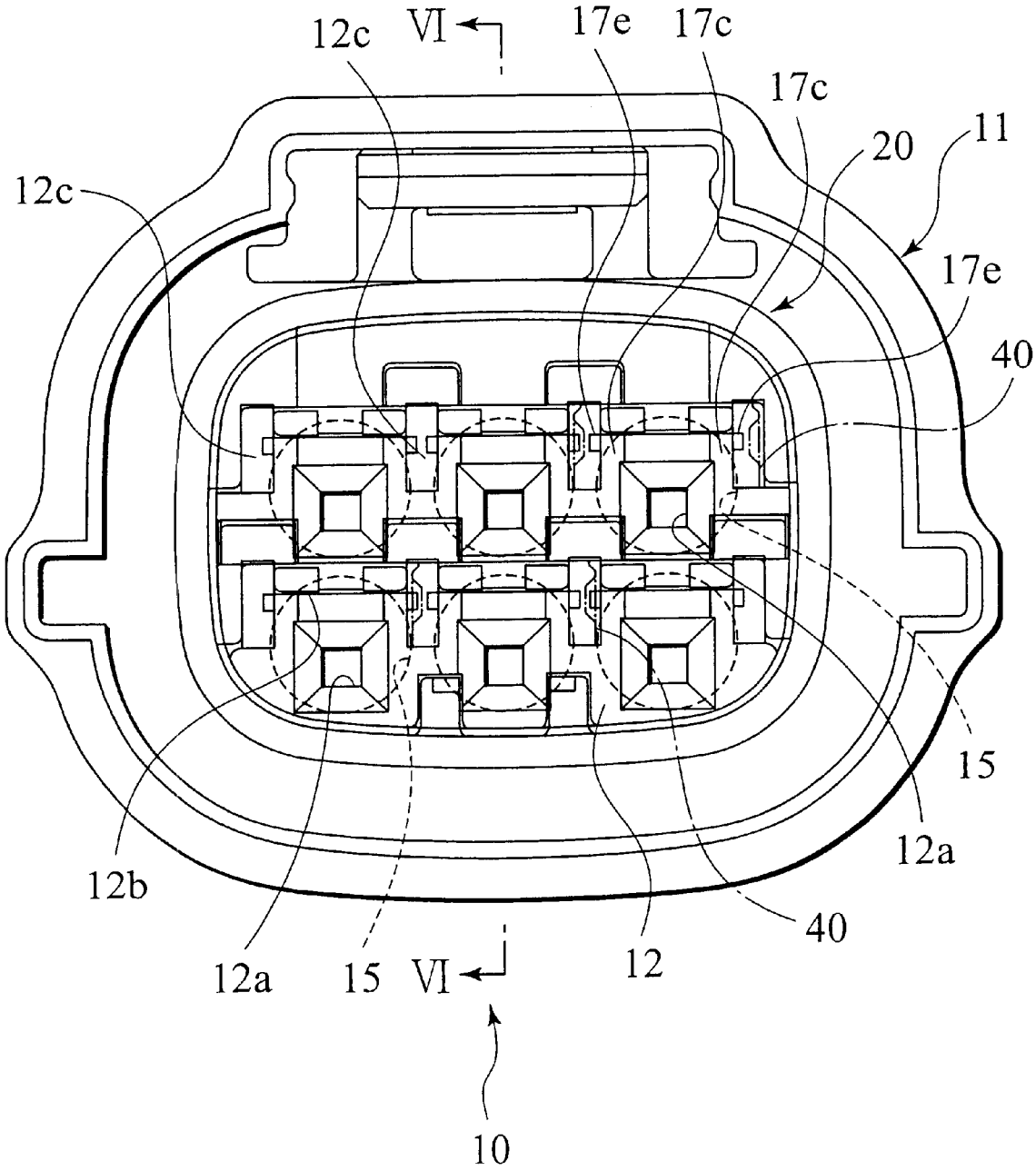
FIG. 5 is a front view of the connector according to the embodiment of this invention.
Figure 6:
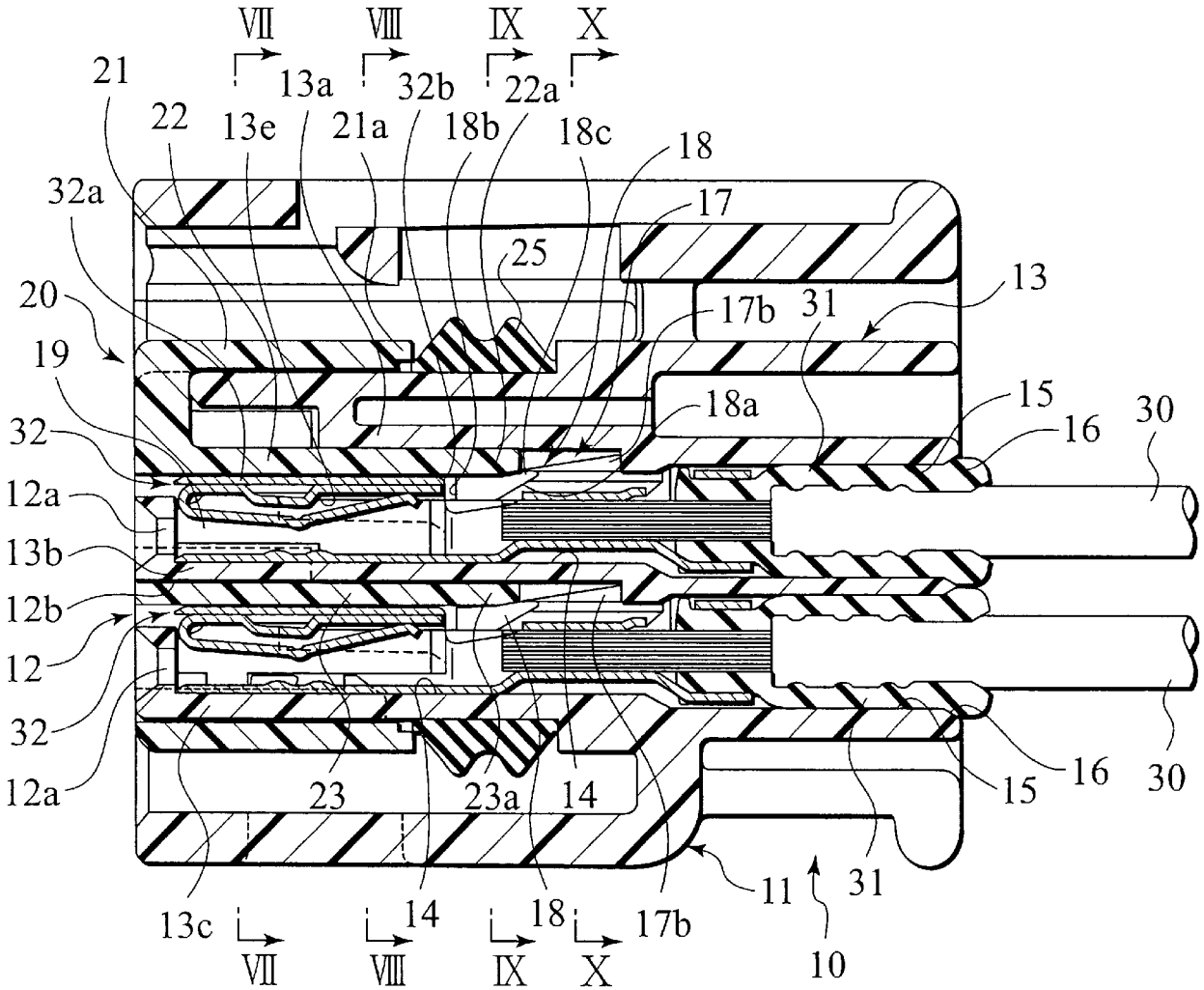
FIG. 6 is a cross-sectional view taken along line VI—VI in FIG. 5.
Figure 7:
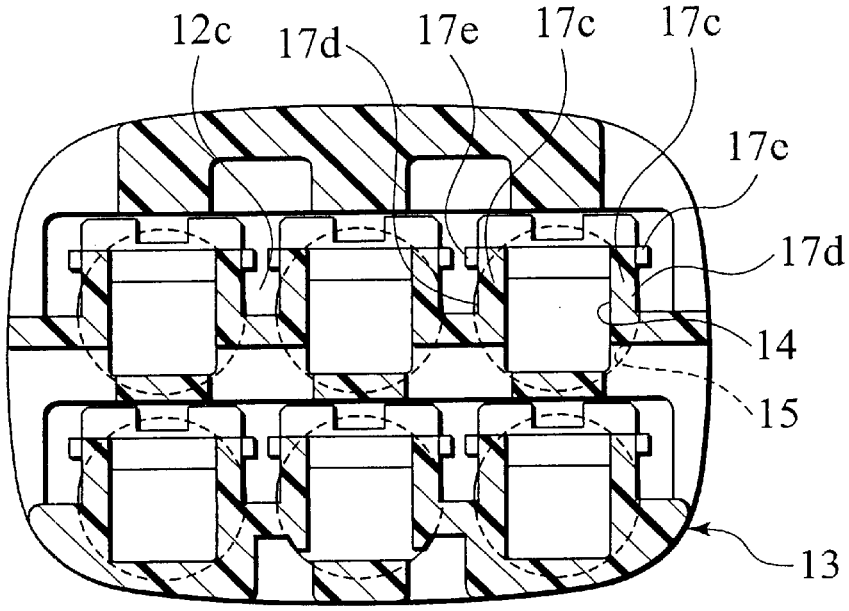
FIG. 7 is a cross-sectional view taken along line VII—VII in FIG. 6.

The front wall 12 of the connector housing 11 is, as shown in FIGS. 5 and 6, formed with terminal insertion holes 12*a* for insertion of mating terminals of a mating connector not shown, which holes 12*a* are opposite to the respective terminal housing chambers 14. Each terminal insertion hole 12*a* is a tapered square hole, diverging outward so as to facilitate the insertion of a mating terminal.

Figure 8:
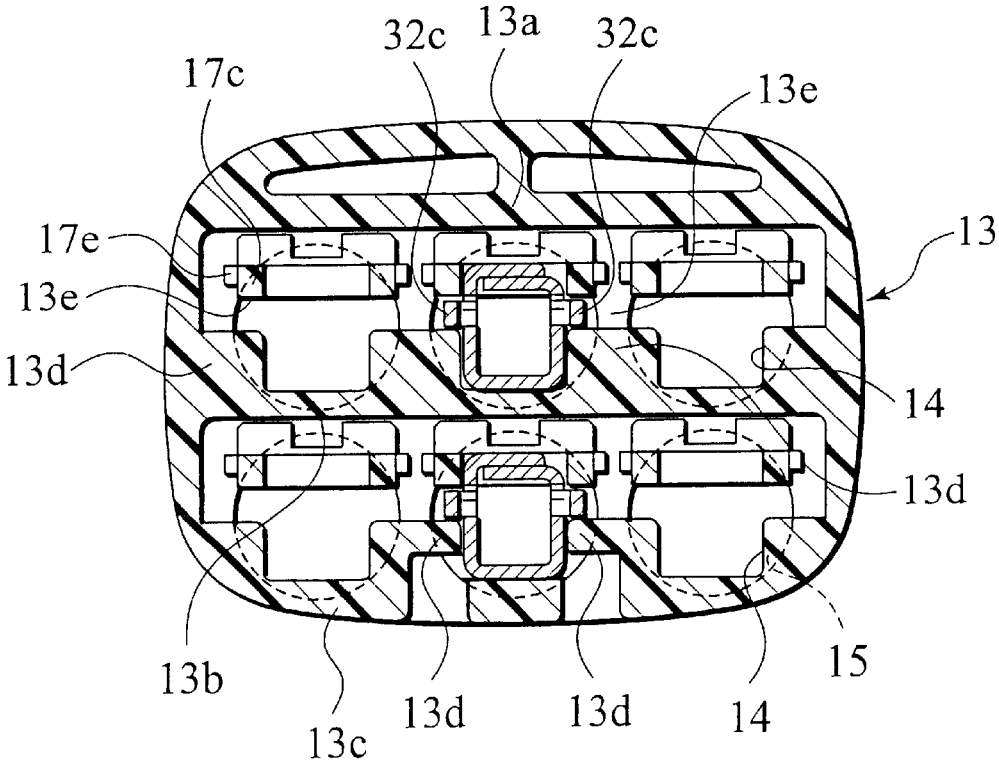
FIG. 8 is a cross-sectional view taken along line VIII—VIII in FIG. 6.
Figure 9:
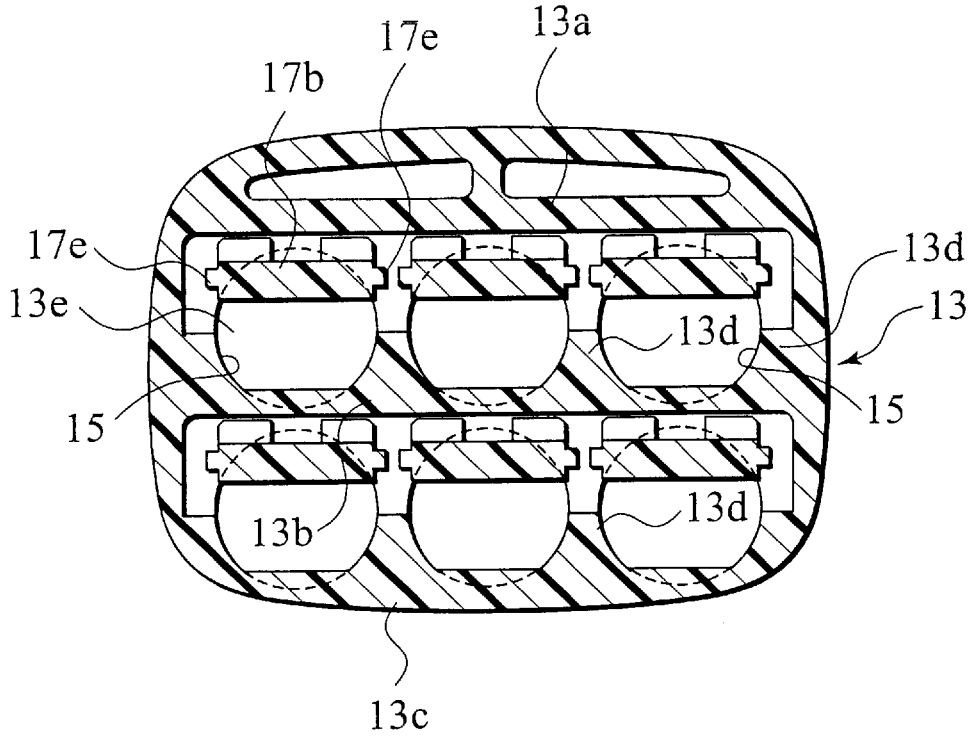
FIG. 9 is a cross-sectional view taken along line IX—IX in FIG. 6.
Figure 10:
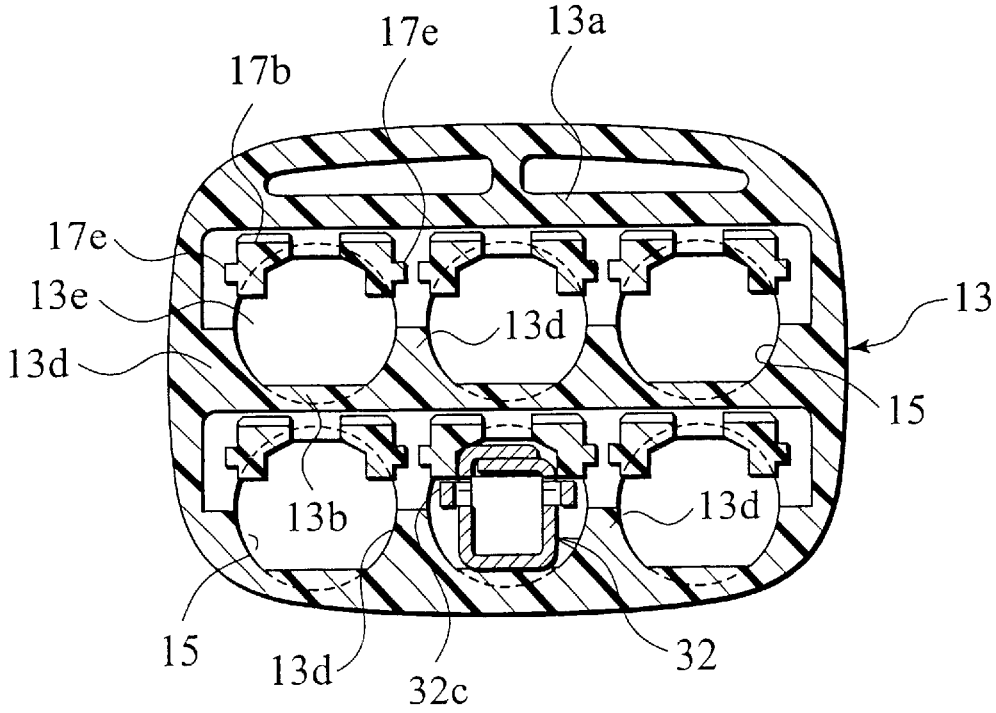
FIG. 10 is a cross-sectional view taken along line X—X in FIG. 6.

The peripheral wall 13 of the connector housing 11 has, as shown in FIGS. 6, 8 and 10, a top wall 13*a*, a partition wall 13*b*, a bottom wall 13*c*, and side walls 13*d*, 13*d*. These walls 13*a* to 13*d* define the terminal housing chambers 14 and the rubber plug housing chambers 15. The front wall 12 is also formed with front openings 12*b* (above the terminal insertion holes 12*a*) for insertion of a front holder 20 to be described later, made from synthetic resin. The front openings 12*b* are opposite to space below the top wall 13*a* of the peripheral wall 13 and space below the partition wall 13*b*.

Referring to FIGS. 4, 6, 15A and 15B, a flexible engagement arm 17 having an engaging portion 18 for engagement with an engaged portion 32*b* of the terminal 32 held in the housing chamber 14, is integrally formed with the front wall 12 opposite to the terminal housing chamber 14 and with a boundary portion of the top wall 13*a* (or the partition wall 13*b* when arranged lower) of the peripheral wall 13, between the terminal housing chamber 14 and the rubber plug housing chamber 15, extending therebetween in a protruding manner. More specifically, a front end 17*a* of the flexible engagement arm 17 is integrally formed with the front wall 12 of the connector housing 11, and a forked rear end 17*b* of the arm 17 is integrally formed with the boundary portion of the top wall 13*a* (or the partition wall 13*b* when arranged lower) of the peripheral wall 13, between the terminal housing chamber 14 and the rubber plug housing chamber 15. Thus the engagement arm 17 is in a fixed-both-ends structure with the front end 17*a* and the rear end 17*b* supported by the front wall 12 of the housing 11 and the peripheral wall 13, respectively.

Figure 15A:
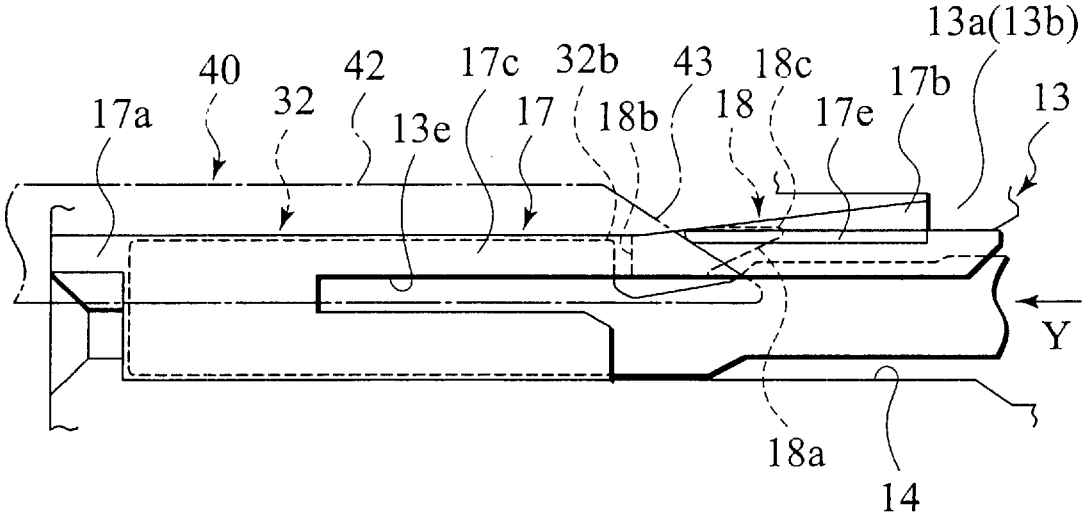
FIG. 15A is a schematic diagram illustrating the state before removal of a terminal according to the embodiment of this invention.
Figure 15B:
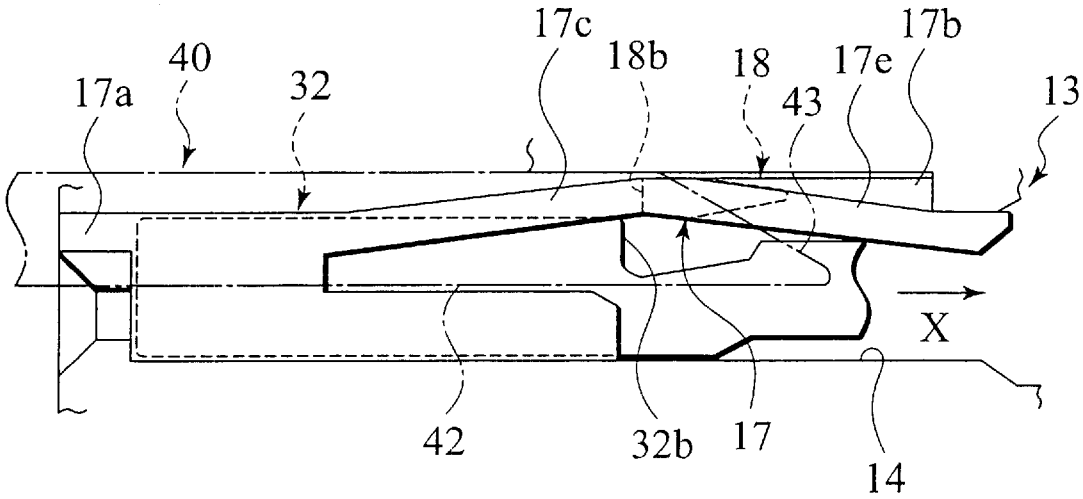
FIG. 15B is a schematic diagram illustrating the removal of the terminal.

The engagement arm 17 has a slit 19 extending from the front end 17*a* to the engaging portion 18 as shown in FIGS. 6, 15A and 15B. The slit 19 has a rectangular shape in a plan view sized to allow a rectangular body 32*a* of the terminal 32 extending forward from the engaged portion 32*b* to be held therein. More specifically, the flexible engagement arm 17 has a pair of supporting arms 17*c*, 17*c* defining the slit 19, extending from the front end 17*a* to the engaging portion 18 and sized to be able to hold the body 32*a* of the terminal 32. On an outer surface 17*d* of each of the supporting arms 17*c*, 17*c*, a protrusion 17*e* is integrally formed, protruding outward, for disengagement by a tool to be described later. Thus the pair of arms 17*c*, 17*c* of the flexible engagement arm 17 resiliently deformable, bends via the slit 19 in a direction substantially orthogonal to a direction Y in which to insert the terminal 32 into the terminal housing chamber 14 (i.e., in a vertical direction).

The engaging portion 18 of the arm 17 has, as shown in FIGS. 15A and 15B, a lower oblique surface 18*a* slanting upward in a rear direction, for facilitating insertion of the terminal 32 into the chamber 14. The front surface of the engaging portion 18 of the arm 17 opposite to the slit 19 constitutes an engaging surface 18*b* orthogonal to the terminal inserting direction Y.

As shown in FIGS. 8, 15A and 15B, a flexion accommodating space 13*e* is provided below the flexible engagement arm 17 inside the side walls 13*d*, 13*d* of the peripheral wall 13 of the connector housing 11. Thus the pair of supporting arms 17*c*, 17*c* of the arm 17 freely bends toward the engaged portion 32*b* of the terminal 32 in a direction orthogonal to the terminal inserting direction Y to make the engaging surface 18*b* of the engaging portion 18 engage with the engaged portion 32*b* of the terminal 32 held in the chamber 14. As shown in FIG. 8, the side walls 13*d*, 13*d* opposite to the flexion accommodating space 13*e* which communicates with the terminal housing chamber 14 guide a pair of protrusions 32*c*, 32*c* on the opposite sides of the body 32*a* of the terminal 32.

A front end 21*a* of an outer peripheral wall 21 of the front holder 20 fitted onto the outer periphery of the peripheral wall 13 of the housing 11 is formed in a stepped shape so as to tightly retain an annular waterproofing packing 25 fitted onto the outer periphery of the peripheral wall 13 of the housing 11 when completely fitted. During fitting, inner peripheral walls 22, 23 of the front holder 20 press upper oblique surfaces 18*c* of the engaging portions 18 of the engagement arms 17 downward so that each terminal 32 held in the chamber 14 is retained with both the engaging portion 18 of the arm 17 and the inner peripheral wall 22, 23 of the front holder 20.

Referring to FIGS. 4, 5 and 7 to 14, on rear portions of the outer surfaces 17*d* of the pair of supporting arms 17*c*, 17*c* of the engagement arm 17, the protrusions 17*e* in a generally rectangular rod shape for a disengagement tool are integrally formed, protruding substantially horizontally outward. The pair of protrusions 17*e*, 17*e* for disengagement is pushed upward by a disengagement tool 40 inserted from front openings 12*c* between the supporting arms 17*c* in the front wall 12 of the connector housing 12.

As shown in FIGS. 4 and 13 to 15, the disengagement tool 40 made from synthetic resin or metal consists of a body 41 in a block shape to be held by an operator and a pair of disengaging members 42, 42 integrally formed with and extending forward of the body 41. Each disengaging member 42 has at its front end a tapered portion 43 for guiding the protrusion 17*e* of the engagement arm 17 upward.

Figure 11:
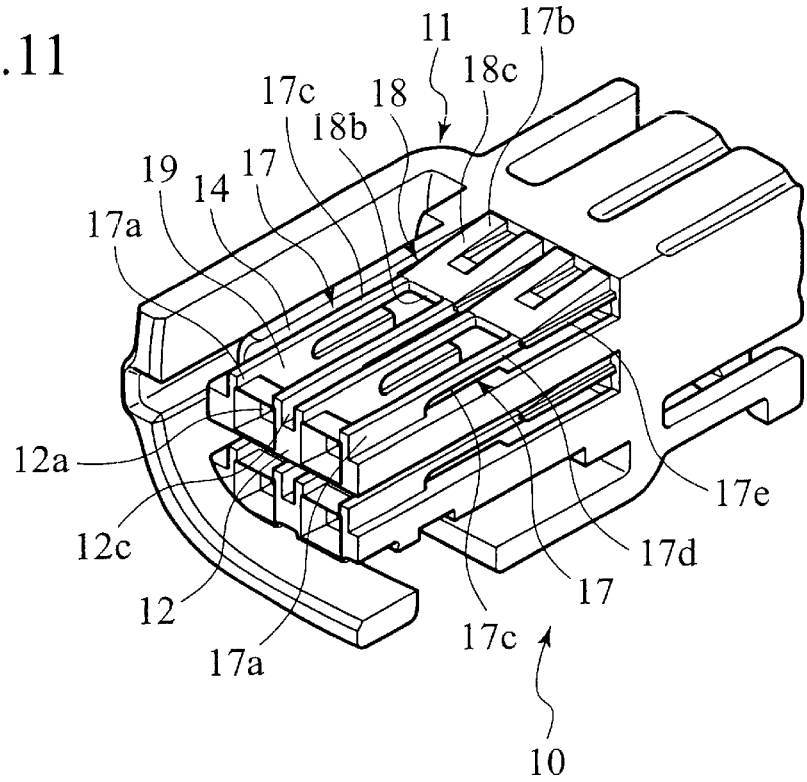
FIG. 11 is a partial perspective view of the connector before insertion of a terminal, according to the embodiment of this invention, with an essential portion shown in cross section.
Figure 12:
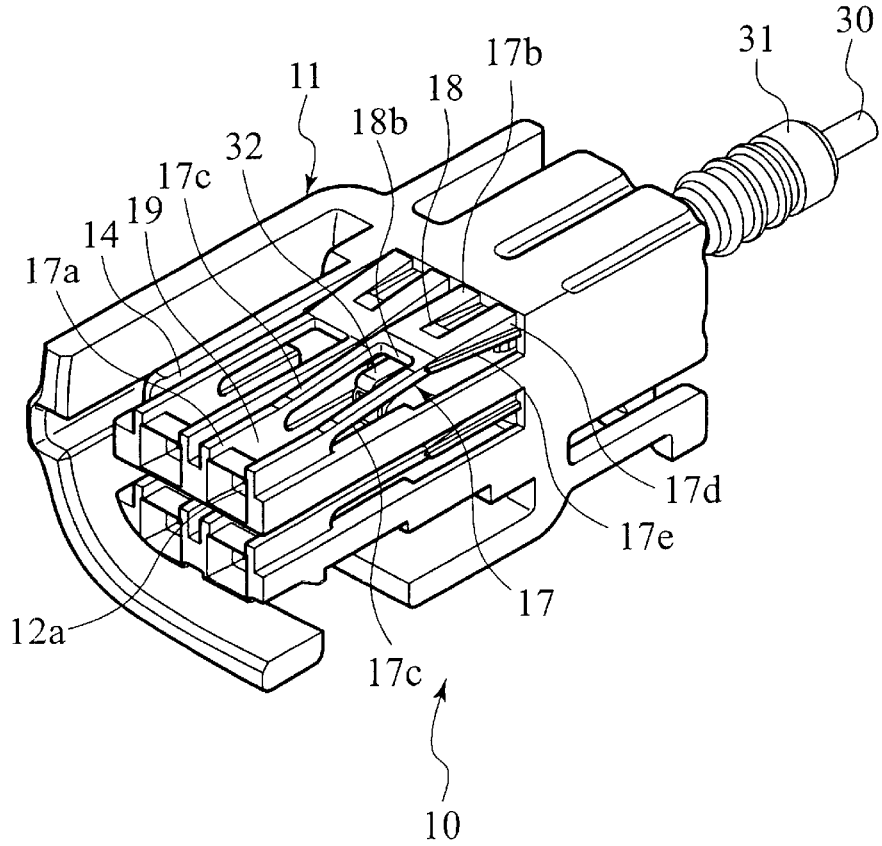
FIG. 12 is a partial perspective view of the connector during insertion of a terminal, according to the embodiment of this invention, with an essential portion shown in cross section.

Referring to FIGS. 11 and 12, in the connector 10 of the above embodiment, when the terminal 32 with the wire 30 and the rubber plug 31 crimped thereon is inserted from the terminal insertion opening 16 at the rear of the housing 11 through the rubber plug housing chamber 15 into the terminal housing chamber 14, the front edge of an upper portion of the body 32*a* of the terminal 32 contacts the lower oblique surface 18*a* of the engaging portion 18 of the engagement arm 17 supported at both ends and extending upward from the front end of the chamber 14 to the rear. Thus the pair of supporting arms 17*c*, 17*c* of the engagement arm 17 bends upward, and the engaging portion 18 of the engagement arm 17 mounts on the body 32*a* of the terminal 32.

When the body 32*a* of the terminal 32 is held in the slit 19 of the engagement arm 17, the pair of arms 17*c*, 17*c* of the engagement arm 17 is returned to the original position to engage at the engaging surface 18*b* of the engaging portion 18 with the engaged portion 32*b* of the terminal 32 held in the chamber 14 as shown in FIGS. 6 and 15A. When the front holder 20 is fitted onto the peripheral wall 13 of the connector housing 11 in this engaging state, the front ends 22*a*, 23*a* of the inner peripheral walls 22, 23 of the front holder 20 press the upper oblique surfaces 18*c* of the engaging portions 18 of the engagement arms 17 downward. Thus the terminal 32 held in the chamber 14 is retained with both the engaging portion 18 of the engagement arm 17 and the inner peripheral walls 22, 23 of the front holder 20.

As described above, the front end 17*a* and the rear end 17*b* of the engagement arm 17 is integrally formed with and supported by the front wall 12 and the peripheral wall 13 of the connector housing 11, defining the terminal housing chamber 14, and the slit 19 is formed in the engagement arm 17, extending from the front end 17*a* of to the engaging portion 18 through which the pair of supporting arms 17*c*, 17*c* of the engagement arm 17 is deformable toward the engaged portion 32*b* of the terminal 32, thereby allowing the engaged portion 32*b* of the terminal 32 held in the chamber 14 to be engaged, so that the flexible arm 17 is unlikely to buckle, resulting in improved retention of the terminal 32 by the engaging portion 18 of the engagement arm 17. Thus when the wire 30 is pulled strongly outward, the engaged portion 32*b* of the terminal 32 contacts the engaging surface 18*b* of the engaging portion 18, being engaged, thereby preventing the terminal 32 from being disengaged from the engagement arm 17.

Figure 13:
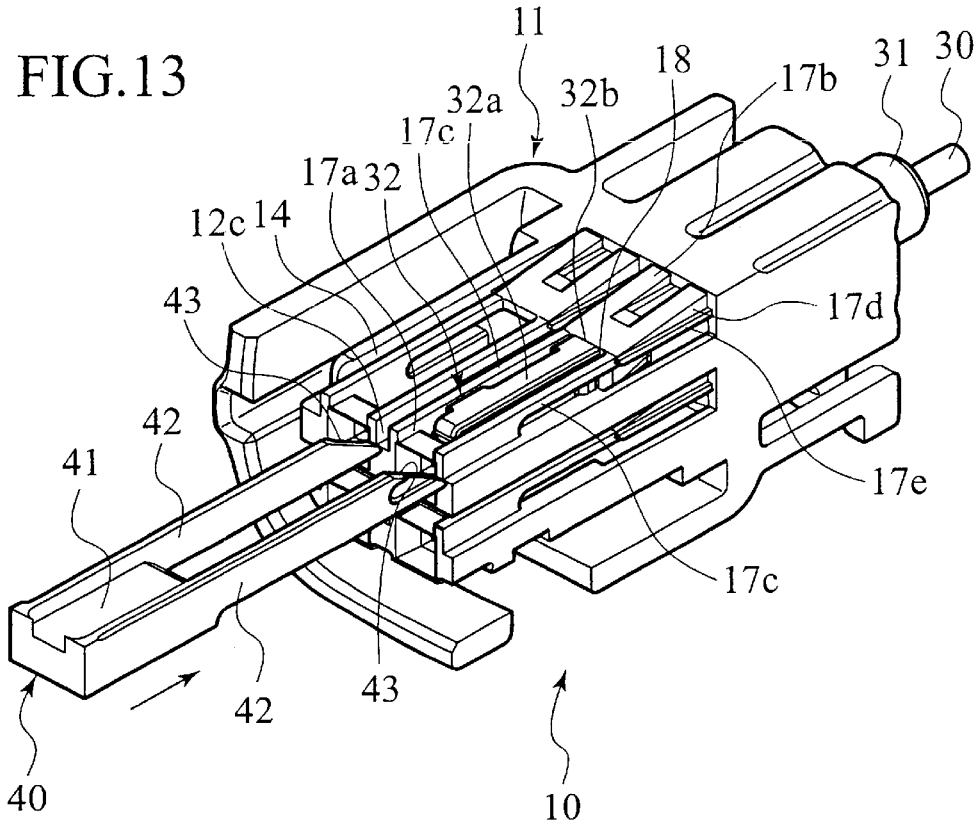
FIG. 13 is a partial perspective view of the connector before removal of a terminal fitted therein, according to the embodiment of this invention, with an essential portion shown in cross section.
Figure 14:
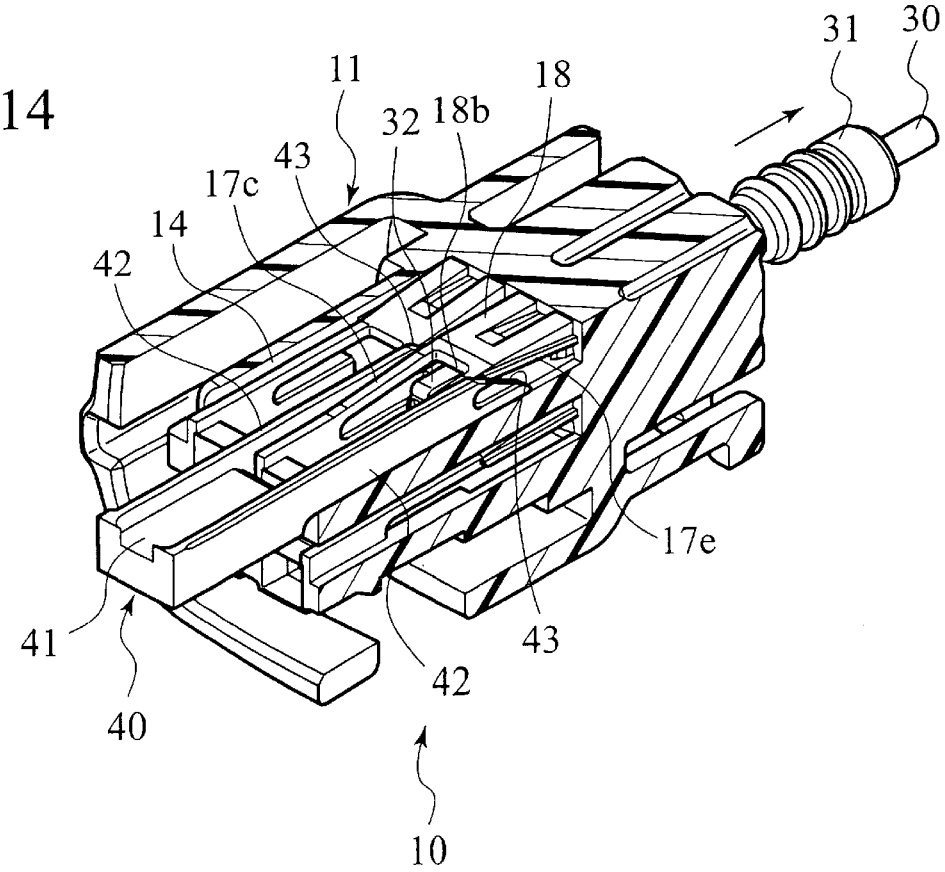
FIG. 14 is a partial perspective view of the connector during removal of a terminal, according to the embodiment of this invention, with an essential portion shown in cross section.

In removing the terminal 32 fitted into the terminal housing chamber 14 of the connector housing 11, the front holder 20 is first removed, and then, as shown in FIG. 13, the pair of disengaging members 42, 42 of the disengagement tool 40 is inserted from the front openings 12*c* of the housing 11. The pair of disengaging members 42, 42 of the tool 40 is inserted along the outer surfaces 17*d* of the pair of the supporting arms 17*c*, 17*c* and contacts at the tapered portions 43 the protrusions 17*e* of the supporting arms 17*c* as shown in FIG. 15A. With the members 42 further inserted, the protrusion 17*e* of the arm 17*c* is held upward on the tapered portion 43 of the member 42. Thus both sides of the engagement arm 17 is held upward, the engaging surface 18*b* of the engaging portion 18 of the engagement arm 17 is disengaged from the engaged portion 32*b* of the terminal 32. In this disengaged state, the terminal 32 is not engaged with the chamber 14 of the housing 11, being allowed to be pulled toward the rubber plug housing chamber 15.

Thus when the engaged portion 32*b* of the terminal 32 is disengaged from the engaging portion 18 of the engagement arm 17 with the disengagement tool 40 having the pair of disengaging members 42, 42, since the protrusions 17*e* for disengagement by the tool 40 is integrally formed with both sides of the engagement arm 17, protruding outward, the pair of supporting arms 17*c*, 17*c* of the engagement arm 17 can be stably deformed in a direction in which the engaging portion 18 of the engagement arm 17 is detached from the engaged portion 32*b* of the terminal 32, resulting in further improved operativity in removing the terminal 32.

In particular, since the body 32*a* of the terminal 32 is held in the slit 19 between the supporting arms 17*c*, 17*c* of the engagement arm 17 and the protrusions 17*e* for disengagement are integrally formed on the outer surfaces 17*d* of the supporting arms 17*c*, 17*c*, protruding outward, when the terminal 32 is removed with the disengagement tool 40, the members 42 of the disengagement tool 40 do not directly contact the terminal 32, resulting in reliable and facilitated disengagement of the engaging portion 18 of the engagement arm 17 from the engaged portion 32*b* of the terminal 32. Thus the members 42 of the tool 40 do not deform or damage the body 32*a* of the terminal 32.

As described above, in removing the terminal 32 from the terminal housing chamber 14 of the connector housing 11, the engagement arm 17 is prevented from being torsionally deformed when dislocated, resulting in smooth and reliable disengagement of the engaging portion 18 of the engagement arm 17 from the engaged portion 32*b* of the terminal 32. The rectangular body 32*a* of the terminal 32 is prevented from being deformed or damaged by the disengagement tool 40, so that after temporarily removed to be adjusted, the same terminal 32 can be used in the assemblage of the connector 10, eliminating the need for preparing new terminal 32, thereby being able to provide the connector 10 at a lower cost.

Although a flexible engagement arm consists of a pair of supporting arms in the above embodiment, it is also possible to provide protrusions for disengagement at both sides of a flexible engagement arm having a fixed end and a free end, with an engaging portion provided at the bottom center of the free end. Although the above embodiment is described with a connector housing a female terminal, it is also possible to apply the above embodiment to a connector housing a male terminal.

According to a first aspect of this invention, disengagement protrusions are provided at both sides of a flexible engagement arm to engage with an engaged portion of a terminal as described above, so that when the engaged portion of the terminal is disengaged from the engaging portion of the engagement arm inside a terminal housing chamber with a disengagement tool to pull out the terminal, the engagement arm can be stably dislocated in a direction in which the engaging portion of the engagement arm is detached from the engaged portion of the terminal, resulting in improved operativity in removing the terminal.

According to a second aspect of this invention, a body of a terminal is held in a slit provided between two supporting arms of a flexible engagement arm, and disengagement protrusions are provided on outer surfaces of the supporting arms, protruding outward, so that when the terminal is removed with a disengagement tool, an engaging portion of the engagement arm can be disengaged from an engaged portion of the terminal with the tool being prevented from directly contacting the terminal. Thus the terminal is prevented from being deformed or damaged by the disengagement tool.

What is claimed is:

1. A connector, comprising:

a connector housing;

a terminal housing chamber provided in the connector housing;

a flexible engagement arm protruding into the terminal housing chamber, the engagement arm having an engaging portion which engages with an engaged portion of a terminal inserted into the terminal housing chamber from the rear thereof; and a protrusion for disengagement by a tool, provided at each side of the flexible engagement arm for disengaging the engaging portion of the flexible engagement arm from the engaged portion of the terminal.

2. A connector according to claim 1, further comprising a pair of supporting arms for supporting the front end of the flexible engagement arm at a front portion of the connector housing and supporting the rear end of the flexible engagement arm at a rear portion of the connector housing, the supporting arms forming a slit sized to allow a body of the terminal to be held therein, the slit being extending from the front end of the flexible engagement arm to the engaging portion, wherein the protrusion for disengagement is provided at an outer surface of each supporting arm, protruding outward.

* * * * *